US006109228A

United States Patent [19]

Yamamoto et al.

[11] Patent Number: 6,109,228

[45] Date of Patent: Aug. 29, 2000

[54] VALVE LIFTER

[75] Inventors: Ken Yamamoto; Takashi Nozaki, both of Shizuoka, Japan

[73] Assignee: NTN Corporation, Osaka, Japan

[21] Appl. No.: 09/134,815

[22] Filed: Aug. 17, 1998

[30] Foreign Application Priority Data

Aug. 22, 1997 [JP] Japan ..... 9-226197

[51] Int. Cl.[7] ..... F01L 1/22

[52] U.S. Cl. ..... 123/90.54; 74/569

[58] Field of Search ..... 123/90.48, 90.49, 123/90.52, 90.53, 90.54; 74/569

[56] References Cited

U.S. PATENT DOCUMENTS

| | | | |
|---|---|---|---|
| 3,823,698 | 7/1974 | Deberg | 123/90.54 |
| 4,321,894 | 3/1982 | Black | 123/90.54 |
| 4,469,057 | 9/1984 | Black | 123/90.54 |
| 4,706,620 | 11/1987 | Gill | 123/90.54 |
| 4,981,117 | 1/1991 | McRobert et al. | 123/90.43 |
| 5,003,940 | 4/1991 | Hixson | 123/90.54 |

FOREIGN PATENT DOCUMENTS 3-8603 1/1991 Japan .

*Primary Examiner*—Weilun Lo

*Attorney, Agent, or Firm*—Wenderoth, Lind & Ponack, L.L.P.

[57] ABSTRACT

A valve lifter includes a guide cap mounted between a cam and the top end of a valve stem and which is slidably supported so as to be capable of moving in the axial direction. The guide cap has an end wall formed with a threaded through-hole. An adjusting bolt is threadedly engaged in the threaded hole. The adjusting bolt is biased toward the valve stem by a spring. The threaded hole and the adjusting bolt have serration-shaped threads so that the adjusting bolt can be moved toward the valve stem under the force of the spring. Since the adjusting bolt is threaded into the threaded hole formed in the guided cap, the axial length of the valve lifter is short.

18 Claims, 3 Drawing Sheets

VALVE LIFTER

BACKGROUND OF THE INVENTION

This invention relates to a valve lifter mounted in a direct type valve drive assembly for opening the valve by directly pushing down the valve with a rotating cam.

An ordinary valve driving assembly for directly pushing down an intake or exhaust valve with a rotating cam includes a valve lifter mounted between the cam and a valve stem. The valve lifter is pressed against the cam by the force of a valve spring which is mounted to the valve stem. Thus, the valve stem is pushed down by the cam through the valve lifter when the valve lifter is pushed down by contact with the cam.

Such a valve lifter is disclosed in unexamined Japanese utility model publication 3-8603. This valve lifter includes a guide cap mounted between the cam and the valve and has a closed end plate, a nut member in contact with the bottom surface of the closed end plate, an adjusting bolt threadedly engaged in the nut member, an engaging plate mounted on the bottom end of the adjusting bolt, and a return spring acting on the adjusting bolt to urge the bolt in the protruding direction and press its bottom end against the valve stem.

The guide cap is formed with a pin hole through which is inserted a pin. The pin is also inserted in a groove formed in the engaging plate near its outer edge to keep the adjusting bolt pushed in.

With this valve lifter, when the pin is pulled out with the valve lifter mounted between the cam and the valve stem, the adjusting bolt will protrude under the force of the return spring until it abuts the top end of the valve stem. In this state, no gap is present between the cam and the valve stem. Thus, this valve lifter can be easily mounted.

If the distance between the top ends of the cam and the valve stem changes due e.g. to temperature fluctuation, the adjusting bolt moves axially while rotating under the force of the return spring to absorb the change in distance. The valve can thus be opened and closed with high accuracy.

With this type of valve lifter, the guide cap and the nut member are separate members. This valve lifter further needs the engaging plate to transmit the spring force to the adjusting bolt. The number of parts is thus large. Therefore, a valve lifter that is lower in cost and easier to assemble is desired.

Further, since the adjusting bolt is threadedly engaged in the nut member in contact with the bottom surface of the closed end plate of the guide cap, the distance between the cam contact surface of the guide cap and the lower end of the adjusting bolt is long. Therefore, the axial length of the valve driving assembly is large. Thus, a more compact valve driving assembly is desired.

An object of this invention is to provide a valve lifter which is made up of a smaller number of parts and thus compact.

SUMMARY OF THE INVENTION

According to this invention, there is provided a valve lifter comprising a guide cap mounted between a cam and the top end of a valve stem and which is supported so as to be slidable in an axial direction. The guide cap has an end plate formed with a threaded hole with a bottom opening, and an adjusting bolt is threadedly engaged in the threaded hole. A resilient member is provided for moving the adjusting bolt toward the valve stem while rotating.

The resilient member may be a spring. As the means for moving the adjusting bolt while turning it, the threaded hole and the adjusting bolt have threads having pressure flanks for bearing axial pushing force applied from the valve stem to the adjusting bolt, and clearance flanks. The threads have such a serrated section that the pressure flanks have a greater flank angle than the clearance flanks.

Other features and objects of the present invention will become apparent from the following description made with reference to the accompanying drawings, in which:

DETAILED DESCRIPTION OF THE PREFERRED EMBODIMENT

An embodiment of this invention will be described with reference to the drawings.

Figure 1:
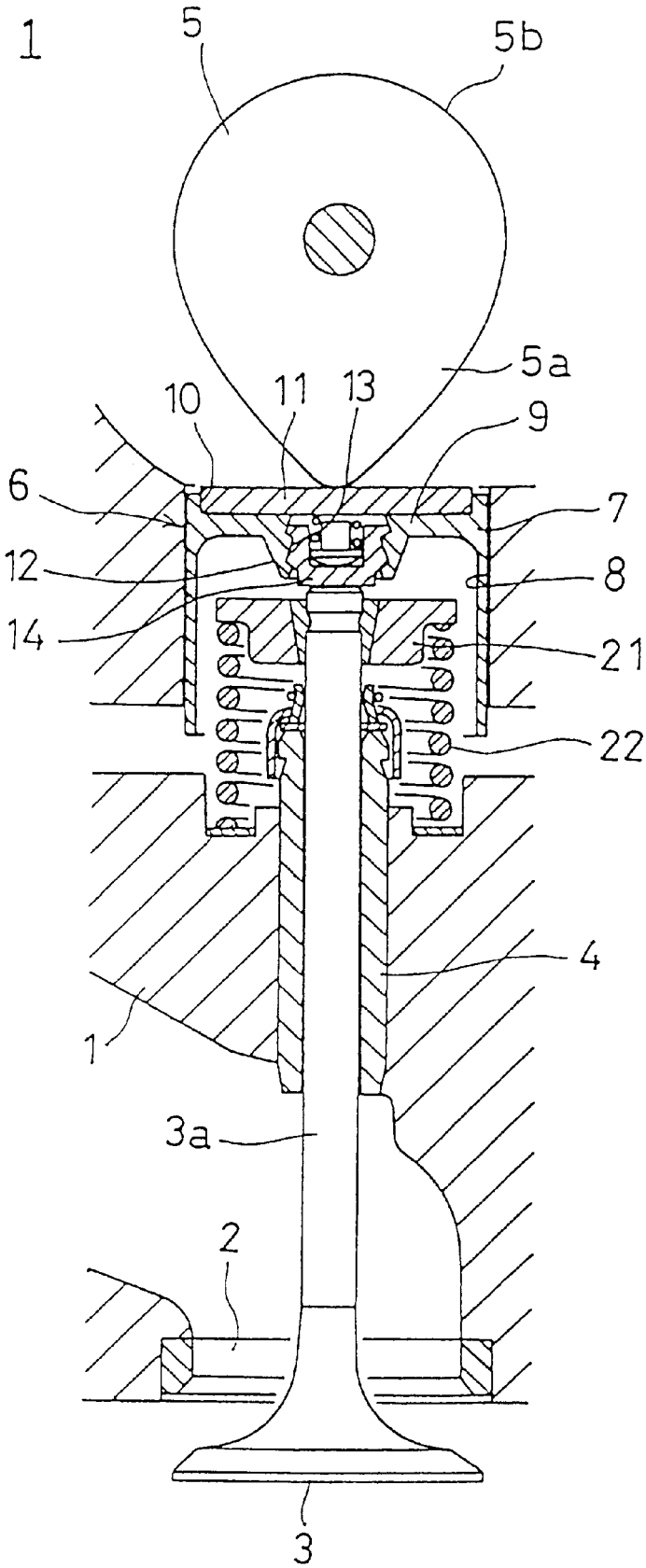
FIG. 1 is a vertical sectional view of a valve lifter of the present invention.

FIG. 1 shows a valve driving assembly for opening and closing an intake port. A valve 3 for opening and closing an inlet port 2 formed in a cylinder head 1 includes a valve stem 3*a* axially slidably supported by a stem guide 4 secured to the cylinder head 1.

Figure 2:
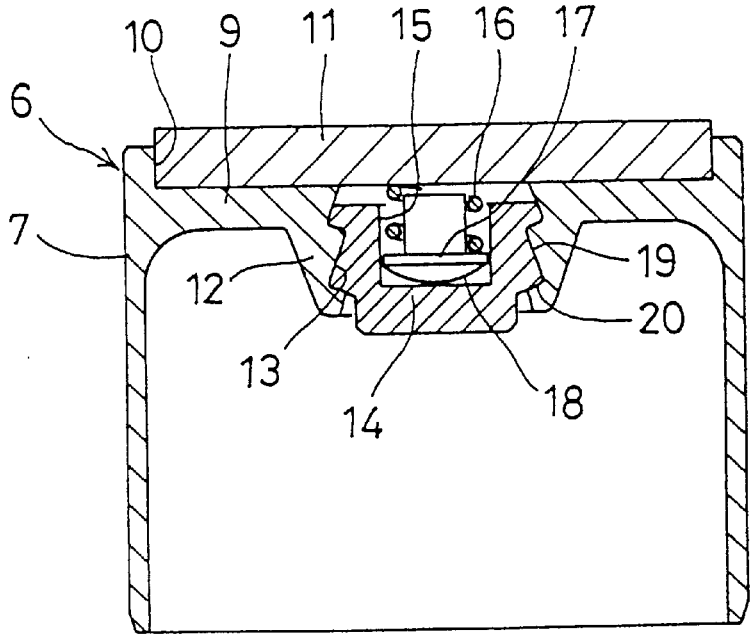
FIG. 2 is an enlarged sectional view of the same.

A valve lifter 6 is mounted between the valve stem 3*a* and a cam 5 provided over the stem 3*a*. As shown in FIG. 2, the valve lifter 6 has a guide cap 7 which is slidably inserted in a guide hole 8 formed in the cylinder head 1.

The guide cap 7 has an end wall 9 having in its top surface a recess 10 in which is received a shim 11 made of a hard material.

The top end wall 9 is provided on its bottom surface with a protrusion 12 having a threaded through-hole 13 in which is threadedly engaged an adjusting bolt 14. The adjusting bolt 14 has an open-topped hole 15 in which a resilient member (such as a spring 16) and a spring seat 17 is received. The spring seat 17 has a spherical bottom 18 which is in point contact with a blind bottom end of the hole 15.

Figure 4:
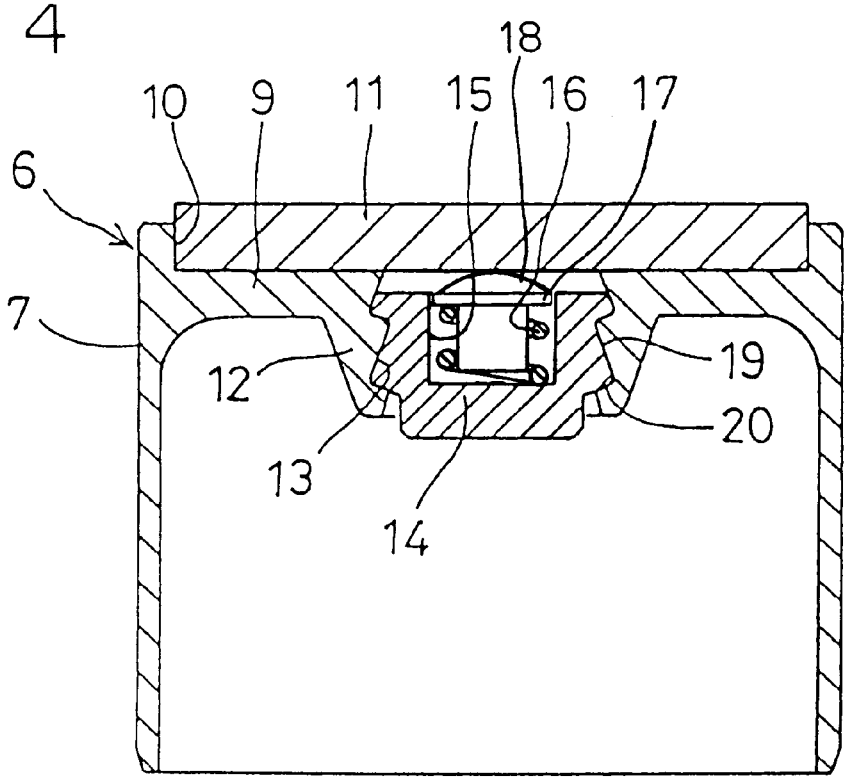
FIG. 4 is a sectional view of another embodiment of this invention.

Alternatively, the spring seat 17 may be arranged between the spring 16 and the shim 11, as shown in FIG. 4.

The threads of the threaded through-hole 13 and those of the adjusting bolts 14 are serrated such that their pressure flanks 19, which bear the axial pushing force applied from the valve stem 3*a* to the adjusting bolt 14, have a greater flank angle than their clearance flanks 20. Also, the relation between the lead angle and flank angle of the threads is determined such that the adjusting bolt 14 can move downward while rotating under the biasing force of the spring 16. When a pushing force is applied from the valve stem 3*a* to the adjusting bolt 14, it is borne by the pressure flanks, so that the bolt 14 will not move axially when the pushing force is smaller than the biasing force of spring 16. When the pushing force exceeds the force of the spring 16, it moves upward while rotating until the pushing force balances with the force of the spring 16.

A spring seat 21 is mounted on the top end of the valve stem 3*a*. A valve spring 22 provided thereunder urges the spring seat 21 in an upward direction. Consequently, the top end of the valve stem 3*a* is pressed against the bottom end of the adjusting bolt 14, and the shim 11 of the valve lifter 6 is pressed against the cam 5.

Now in operation, when the cam 5 rotates and the valve lifter 6 is pushed down by the crest 5*a* of the cam 5, the valve stem 3*a* is pushed down by the adjusting bolt 14, so that the valve 3 lowers, opening the inlet port 2. When the base circle 5*b* of the cam 5 comes to a position opposite the shim 11, the valve 3 and the valve lifter 6 rise under the force of the valve spring 22, thus closing the inlet port 2.

If the distance between the base circle 5*b* of the cam 5 and the top end of the valve stem 3*a* changes (for example, increases due to temperature fluctuation), the adjusting bolt 14 moves downward while rotating under the force of the spring 16, thus absorbing the change in distance.

If the distance shortens, the pushing force acting on the adjusting bolt 14 becomes greater than the force exerted by spring 16 so that the bolt 14 moves upward while rotating, thus absorbing the change in distance.

Thus, if the distance changes due to temperature change or deviates due to error in manufacturing parts or assembling error, the adjusting bolt 14 will move axially, thus absorbing such change in distance or deviation. therefore no gap is formed between the cam 5 and the shim 11 or between the valve stem 3*a* and the adjusting bolt 14. The valve 3 can thus be opened and closed with high accuracy.

While the adjusting bolt 14 is rotating, it is kept in point contact with the spring seat 17, so that the adjusting bolt 14 can rotate smoothly.

Figure 3:
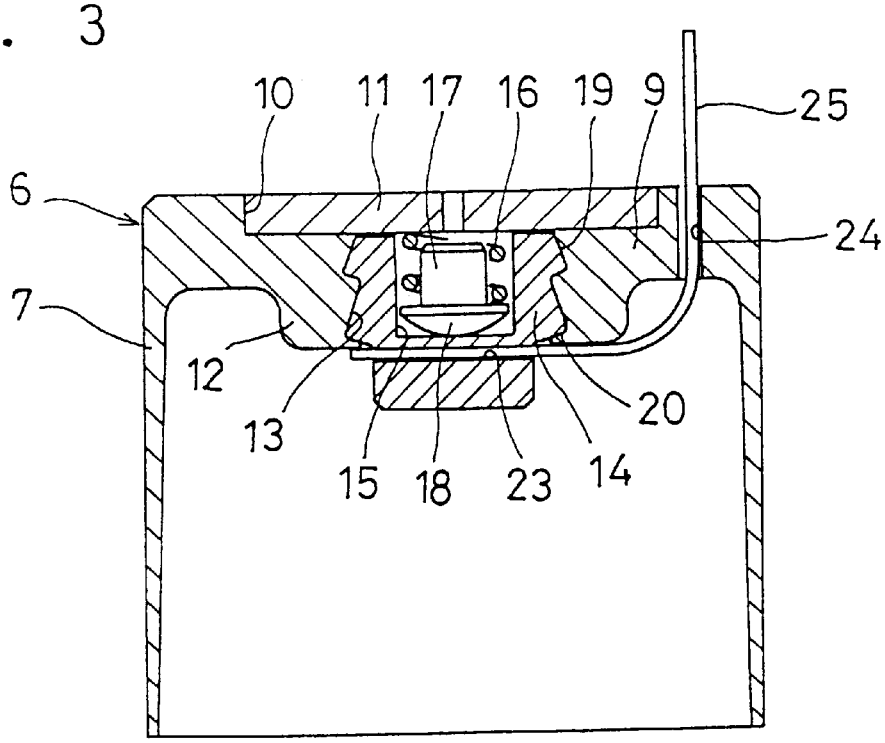
FIG. 3 is a sectional view of another embodiment of this invention.

FIG. 3 shows another embodiment of this invention. In this embodiment, a diametrical hole 23 is formed through the adjusting bolt 14 at its bottom portion that protrudes downward from the threaded through hole 13 in which the adjusting bolt 14 is disposed. A vertical pin hole 24 is formed through the closed end wall 9 of the guide cap 7 near its outer perimeter. A pin 25 is inserted through the pin hole 24 and the diametrical hole 23 in the adjusting bolt 14 to check the rotation of the bolt 14 and keep it pushed in the threaded through hole 13.

With the valve lifter in which the rotation of the adjusting bolt 14 is prevented with the bolt 14 pushed in, when the pin 25 is pulled out with the valve lifter mounted between the top end of the valve stem 3*a* and the cam 5 and with the shim 11 on the guide cap 7 in contact with the base circle 5*b* of the cam 5, the adjusting bolt 14 moves axially while rotating under the force of the spring 16 until its bottom end comes into contact with the top end of the valve stem 3*a*. The valve lifter can thus be mounted easily.

According to the invention, if the distance between the cam and the top end of the valve stem deviates due to manufacturing or assembling error, or changes due to temperature fluctuation, the adjusting bolt moves axially while rotating to absorb such deviation or change in distance. The valve can thus be opened and closed with high accuracy.

Since the adjusting bolt is threaded into the through hole formed in the bottom surface of the closed end plate, a nut member needed in a conventional valve lifter is not needed. This results in a reduced number of parts, easier assembly and lower cost.

Furthermore, since the adjusting bolt is threaded into the threaded hole formed in the closed end plate, the distance between the cam contact surface of the guide cap and the bottom end of the adjusting bolt can be shortened compared with conventional arrangements. Thus, it is possible to reduce the axial length of the valve driving assembly.

A spring seat having a spherical bottom is mounted between the adjusting bolt and the spring or between the spring and the closed end of the threaded hole. The adjusting bolt can thus be turned smoothly.

According to the invention, the adjusting bolt can be prevented from rotating by inserting a pin. It is thus kept pushed in, so the valve lifter can be mounted easily.

What is claimed is:

1. A valve apparatus comprising:

a guide cap including an end wall having a top surface and a recess formed in said top surface, said recess having a threaded through-hole extending through said recess in said top surface of said end wall to a bottom surface of said end wall;

an adjusting bolt threaded in said through-hole;

a shim plate arranged in said recess; and a resilient member for moving said adjusting bolt downward while said adjusting bolt rotates.

2. The apparatus of claim 1, wherein said through-hole and said adjusting bolt have threads including pressure flanks for bearing an axial force applied to said adjusting bolt, and clearance flanks, said threads being formed such that said pressure flanks have a flank angle larger than a flank angle of said clearance flanks.

3. The apparatus of claim 2, wherein said resilient member comprises a spring.

4. The apparatus of claim 3, further comprising a spring seat arranged between said spring and said adjusting nut, said spring seat having a spherical surface in contact with said adjusting nut.

5. The apparatus of claim 3, further comprising a spring seat arranged between said spring and said shim plate, said spring seat having a spherical surface in contact with said shim plate.

6. The apparatus of claim 1, wherein said resilient member comprises a spring.

7. The apparatus of claim 6, further comprising a spring seat arranged between said spring and said adjusting nut, said spring seat having a spherical surface in contact with said adjusting nut.

8. The apparatus of claim 6, further comprising a spring seat arranged between said spring and said shim plate, said spring seat having a spherical surface in contact with said shim plate.

9. The apparatus of claim 1, wherein said adjusting bolt has a hole facing said shim, said resilient member being arranged within said hole so as to exert a downward force against said adjusting bolt.

10. A valve apparatus comprising:

a cylinder head including a port;

a valve for opening and closing said port, said valve including a valve stem having a top end;

a cam;

a guide cap including an end wall having a top surface and a recess formed in said top surface, said guide cap being slidably mounted in said cylinder head and between said cam and said valve stem so as to be capable of axial movement, said recess having a threaded through-hole extending through said recess in said top surface of said end wall to a bottom surface of said end wall;

an adjusting bolt threaded in said through-hole;

a shim plate arranged in said recess; and a resilient member for moving said adjusting bolt toward said top end of said valve stem while said adjusting bolt rotates.

11. The apparatus of claim 10, wherein said through-hole and said adjusting bolt have threads including pressure flanks for bearing an axial force applied to said adjusting bolt by said valve stem, and clearance flanks, said threads being formed such that said pressure flanks have a flank angle larger than a flank angle of said clearance flanks.

12. The apparatus of claim 11, wherein said resilient member comprises a spring.

13. The apparatus of claim 12, further comprising a spring seat arranged between said spring and said adjusting nut, said spring seat having a spherical surface in contact with said adjusting nut.

14. The apparatus of claim 12, further comprising a spring seat arranged between said spring and said shim plate, said spring seat having a spherical surface in contact with said shim plate.

15. The apparatus of claim 10, wherein said resilient member comprises a spring.

16. The apparatus of claim 15, further comprising a spring seat arranged between said spring and said adjusting nut, said spring seat having a spherical surface in contact with said adjusting nut.

17. The apparatus of claim 15, further comprising a spring seat arranged between said spring and said shim plate, said spring seat having a spherical surface in contact with said shim plate.

18. The apparatus of claim 10, wherein said adjusting bolt has a hole facing said shim, said resilient member being arranged within said hole so as to exert a downward force against said adjusting bolt.

* * * * *